US008312922B2

(12) United States Patent
Nelson

(10) Patent No.: US 8,312,922 B2
(45) Date of Patent: Nov. 20, 2012

(54) METAL-TO-METAL SEAL WITH TRAVEL SEAL BANDS

(75) Inventor: John E. Nelson, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 467 days.

(21) Appl. No.: 12/476,937

(22) Filed: Jun. 2, 2009

(65) Prior Publication Data

US 2010/0300705 A1 Dec. 2, 2010

(51) Int. Cl.
*E21B 23/00* (2006.01)
*E21B 43/10* (2006.01)
*E21B 33/00* (2006.01)

(52) U.S. Cl. ..... 166/208; 166/217; 277/322

(58) Field of Classification Search ..... 166/82, 166/138, 191, 196, 208, 217, 348, 387; 188/67; 277/336, 322

See application file for complete search history.

(56) References Cited

U.S. PATENT DOCUMENTS 4,641,708 A * 2/1987 Wightman ..... 166/208
4,665,979 A * 5/1987 Boehm, Jr. ..... 166/208
4,932,472 A * 6/1990 Boehm, Jr. ..... 166/208
4,949,786 A * 8/1990 Eckert et al. ..... 166/208
4,960,172 A * 10/1990 Nelson ..... 166/208
5,060,724 A 10/1991 Brammer et al.
5,067,734 A * 11/1991 Boehm, Jr. ..... 277/328
5,285,853 A * 2/1994 Eckert et al. ..... 166/382
5,327,965 A * 7/1994 Stephen et al. ..... 166/208
5,456,314 A * 10/1995 Boehm et al. ..... 166/208
6,367,558 B1 4/2002 Borak, Jr.
7,237,613 B2 * 7/2007 Radi et al. ..... 166/359
7,861,789 B2 * 1/2011 Nelson ..... 166/348
2008/0135229 A1 * 6/2008 Hunter et al. ..... 166/84.1

* cited by examiner

*Primary Examiner* — Jennifer H Gay
*Assistant Examiner* — Michael Wills, III
(74) *Attorney, Agent, or Firm* — Bracewell & Giuliani LLP

(57) ABSTRACT

A wellhead seal assembly that forms a metal-to-metal seal between inner and outer wellhead members. A metal seal ring has inner and outer walls separated by a slot. The exterior surfaces of the outer and inner walls contain a soft metal inlay. A wicker profile with a slick area is located on the outer surface of the inner wellhead member and on the inner surface of the outer wellhead member. An energizing ring is moved into the slot to force the outer and inner walls of the seal into sealing engagement with the inner and outer wellhead members. The soft metal inlays deform onto the slick area on the wellhead members. The wickers on the wellhead members embed into the walls of the seal ring.

19 Claims, 2 Drawing Sheets

METAL-TO-METAL SEAL WITH TRAVEL SEAL BANDS

FIELD OF THE INVENTION

This invention relates in general to wellhead assemblies and in particular to a seal for sealing between inner and outer wellhead members.

BACKGROUND OF THE INVENTION

Seals are used between inner and outer wellhead tubular members to contain internal well pressure. The inner wellhead member may be a casing hanger located in a wellhead housing and that supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal has inner and outer walls separated by a cylindrical slot. An energizing ring is pushed into the slot in the seal to deform the inner and outer walls apart into sealing engagement with the inner and outer wellhead members. The energizing ring is a solid wedge-shaped member. The deformation of the seal's inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

One approach taken to address this leakage problem in metal-to-metal seals has been the addition of a set of wickers to the exterior of the casing hanger with the bore of the wellhead housing remaining slick. The wickers on the casing hanger sealingly engage the inner wall of the seal after it is deformed by the energizing ring and lock the seal into place. However, with travel of the seal due to thermal and pressure effects, the seal can experience a moment that leads to leakage on the side with the slick bore.

Another approach called for the use of a set of wickers on both the bore of the wellhead housing and on the exterior of the casing hanger. The wickers sealingly engaged both the outer and inner walls of the seal after they were deformed by the energizing ring. This locked the annulus seal into place on both sides, eliminating the effect of the moment that caused the seal to slide and pivot along the slick bore surface as described above. However, seal travel due to thermal growth cycles and continued increases in production pressure still resulted in seal leakage.

A need exists for a technique that addresses the seal leakage problems described above. In particular a need exists for a technique to maintain a seal between inner and outer wellhead members experiencing changes in relative positions due to thermal affects, especially those caused by high pressure and high temperature wellbore conditions. The following technique may solve these problems.

SUMMARY OF THE INVENTION

In an embodiment of the present technique, a seal assembly is provided that forms a metal-to-metal seal and has features that restrain axial movement of the seal assembly. The seal assembly also has features that maintain the seal even when increased thermal and pressure effects result in axial movement. The seal ring has inner and outer walls separated by a slot. A metal energizing ring is pushed into the slot during installation to deform the inner and outer walls into sealing engagement with inner and outer wellhead members.

In the illustrated embodiments, a radial gap exists between the outer wall of the seal and the inner wall of the mating housing. Such gap is required for installation in the field and is sufficiently large to require plastic deformation of the seal body, but not the energizer ring. In order to accommodate sealing over scratches and surface trauma of the wellhead members, soft metallic inlays form a band around the exterior surfaces of the seal inner and outer walls. The inlays have grooves formed on the sealing side of the inlay and are preferably in a V configuration to assist in the flow of inlay material to provide a seal. The size and thickness of the metallic inlays are sufficient to provide for scratch filling and therefore sealing between the mating members.

In an illustrated embodiment, a set of wickers is located on both the bore of the wellhead housing and on the exterior of the casing hanger. The profile of each set of wickers is interrupted by a cylindrical slick area. In this example, the height of the slick areas is slightly less than the height of the soft metallic inlays located on the seal but the ratio of the heights can vary. The wickers sealingly engage both the outer and inner walls of the seal after they are deformed by the energizing ring. The wickers grip the seal ring walls and lock it into place to prevent the seal from pivoting due to the moment caused by the relative axial movement of the wellhead members. If thermal growth cycles or pressure cause axial movement of the seal assembly, the soft metallic inlay bands deformed against the slick areas can then maintain a seal by sliding or traveling along the slick area. Alternatively, the set of wickers can be located on the exterior of an inner wellhead member such as a tubing hanger, with another set of wickers located on the bore of an outer wellhead member, which may be a wellhead housing, a Christmas tree, or tubing head.

In the embodiment shown, the seal assembly also comprises the energizing ring that engages the slot. The retainer ring rests in a machined pocket on the outer surface of the energizing ring. The outer leg of the seal ring is machined with a taper that engages a taper formed on the retainer ring. The engagement ensures that the seal assembly remains intact as one solid structure during landing, setting, and retrieval operations. The retainer ring can alternatively rest in a machined pocket on the inner surface of the energizing ring to lock the seal onto the hanger.

The combination of stored energy provided for by the energizing rings, the locking mechanisms of the seal ring and the energizing ring, the slick areas interrupting the wicker profiles, and the compliant soft outer inlays, provides gas tight sealing under extreme thermal conditions. Alternatively, the soft inlays may be made from a non-metallic material or polymer such as PEEK (poly-ether-ether-keytone) or PPS (polyphenylene sulfide).

DETAILED DESCRIPTION OF THE INVENTION

Figure 1:
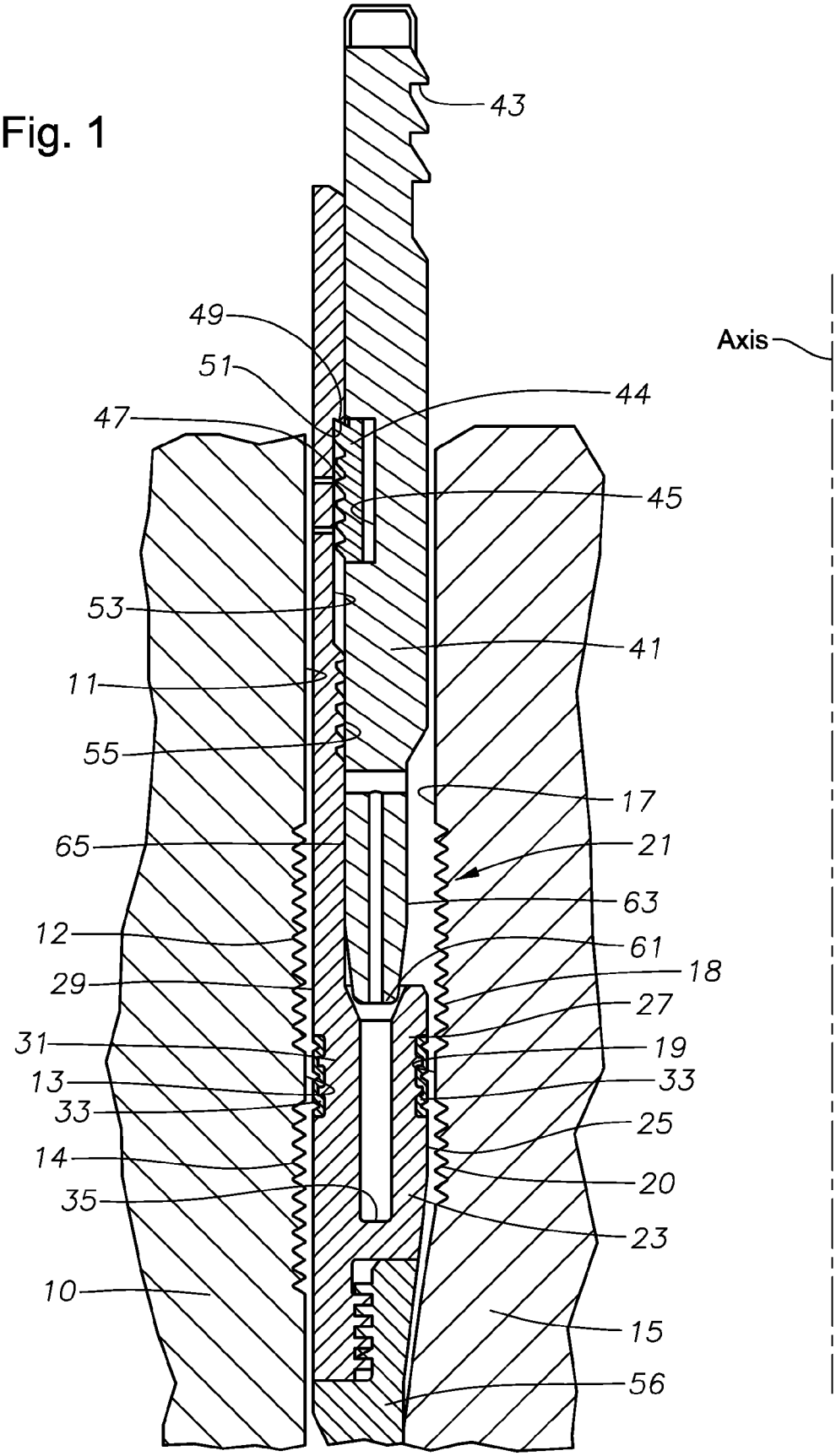
FIG. 1 is a sectional view of a seal assembly with the energizing ring locked to the seal, but unset, in accordance with an embodiment of the invention.

Referring to FIG. 1, an embodiment of the invention shows a portion of a high pressure wellhead housing 10. Housing 10 is located at an upper end of a well and serves as an outer wellhead member in this example. Housing 10 has a bore 11 located therein.

In this example, the inner wellhead member comprises a casing hanger 15, which is shown partially in FIG. 1 within bore 11. Alternately, wellhead housing 10 could be a tubing spool or a Christmas tree and casing hanger 15 could instead be a tubing hanger, plug, safety valve, or other device. Casing hanger 15 has an exterior annular recess radially spaced inward from bore 11 to define a seal pocket 17. Wickers 12 and a slick area 13 are located on the wellhead bore 11 and wickers 18 and a slick area 19 are located on the cylindrical wall of seal pocket 17. In this example, the profiles of each set of wickers 12, 18 are interrupted by the slick areas 13, 19 such that wickers 12, 18 are located above and below the slick areas 13, 19. However, the wickers 12, 18 and slick areas 13, 19 may be configured in other arrangements. For example, the slick areas 13, 19 may be located at one or more ends of a single set of wickers 12, 18, rather than interrupting the wickers 12, 18.

A metal-to-metal seal assembly 21 is located in seal pocket 17. Seal assembly 21 includes a seal ring 23 formed of a metal such as steel. Seal ring 23 has an inner wall 25 comprised of inner seal leg 27 for sealing against the cylindrical wall of casing hanger 15. Seal ring 23 has an outer wall surface 29 comprised of outer seal leg 31 that seals against wellhead housing bore 11. In this example outer wall 29 contains inlays 33 formed of a soft metal such as tin indium or alternatively made from a non-metallic material or polymer such as PEEK (poly-ether-ether-keytone) or PPS (polyphenylene sulfide). Each wall surface 25, 29 is cylindrical and smooth, except for the portions of the walls containing the soft metal inlays 33. The inlays 33 have grooves formed on the sealing side of the inlay 33. The grooves are preferably in a V configuration and assist in the flow of inlay material to provide a seal. Inlay 33 aligns with smooth cylindrical surface 13 and 19 when seal assembly 21 is in pocket 17.

In this example, seal ring 23 is unidirectional, having an upper section only; however, a seal ring that is bi-directional may be used. The upper section has a slot 35. The inner and outer surfaces forming slot 35 comprise generally cylindrical surfaces that may be straight.

An energizing ring 41 engages slot 35 on the upper side. Energizing ring 41 is forced downward into slot 35 by a running tool (not shown) connected to grooves 43 on the inner diameter of upper energizing ring 41 during setting. Alternatively, seal assembly 21 and energizing ring 41 may be part of a string that is lowered into bore 11, the weight of which forces energizing ring 41 into slot 35. If retrieval is required, the grooves 43 can be engaged by a retrieving tool (not shown) to pull energizing ring 41 from set position. Energizing ring 41 can be formed of metal, such as steel. The mating surfaces of energizing ring 41 and outer seal leg 31 may be formed at a locking taper.

In an embodiment of the invention, an outwardly biased retainer ring 44 is carried in a pocket 45 on the outer surface of upper energizing ring 41. Ring 44 has parallel grooves 47 on its outer surface and an edge that forms an upward facing shoulder 49. The inner surface of outer seal leg 31 contains a downward facing shoulder 51 that abuts against shoulder 49 of retainer ring 44, preventing energizing ring 41 from pulling out of seal ring 23 once the two are engaged.

Figure 2:
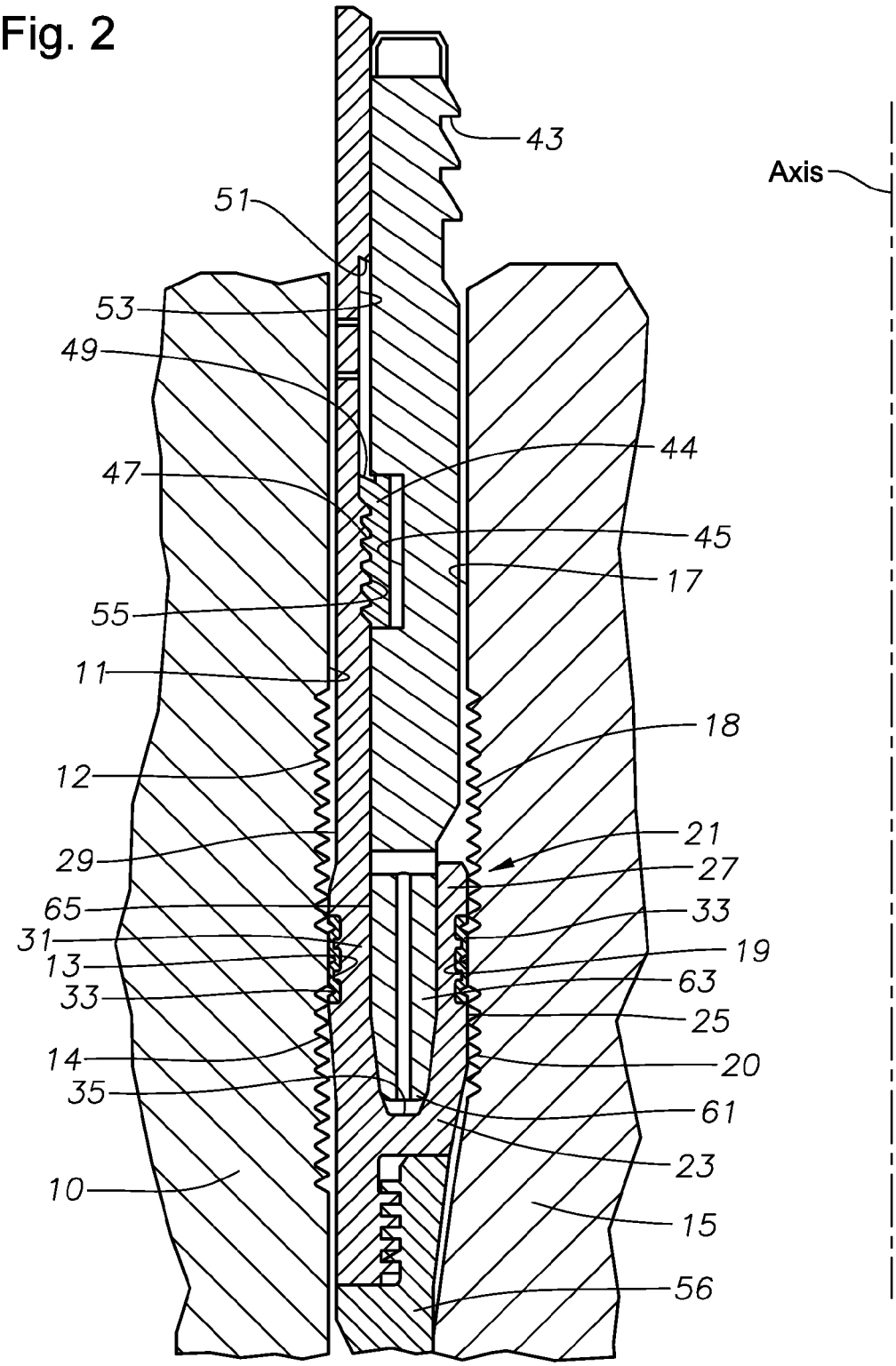
FIG. 2 is a sectional view of the seal assembly of FIG. 1 in the set position with deformation of the seal and soft inlay material in accordance with an embodiment of the invention.

As shown in FIGS. 1 and 2, a recess 53 is formed below shoulder 51 on the inner surface of outer seal leg 31. Parallel grooves 55 are formed on the inner surface of outer seal leg 31 just below recess 53. When energizing ring 41 is set, retainer ring 44 will move radially from pocket 45, and grooves 47 on the outer surface of retainer ring 44 will engage and ratchet by grooves 55 on the inner surface of outer seal leg 31, locking energizing ring 41 to seal ring 23. Retainer ring 44 can move downward relative to grooves 55, but not upward.

Energizing ring 41 has a wedge member 61 or engaging portion that engages slot 35. Energizing ring 41 has an inner surface 63 and an outer surface 65 for engaging the opposite inner sidewalls of slot 35 in seal ring 23. Inner and outer surfaces 63, 65 may be straight surfaces as shown, or curved surfaces.

A lower extension 56 secures by threads to the lower portion of seal ring 23. The lower extension 56 extends down to contact an upward facing shoulder (not shown) on the interior of casing hanger 15. Alternatively, the lower extension 56 can extend down to contact an upward facing shoulder (not shown) on a locking mechanism that locks the seal assembly to a wellhead member as the energizing ring 41 applies force through the seal ring 23 and down through the lower extension 56.

In operation of the embodiment shown in FIGS. 1 and 2, a running tool or string (not shown) is attached to seal assembly 21 (FIG. 1) and lowered into the seal pocket 17 formed by the exterior annular recess of the casing hanger 15 and the bore 11 of the wellhead housing 10, with the lower extension 56 landing on the shoulder (not shown) of the casing hanger 15. Seal assembly 21 is pre-assembled with energizing ring 41, retainer ring 44, seal ring 23, and extension 56 all connected to one another. The running tool or string (not shown) can be attached to threads 43 on energizing ring 41. The outer wall 29 of outer seal leg 31 will be closely spaced to wickers 12 and slick area 13 on the wellhead bore 11. The inner wall 25 of inner seal leg 27 will be closely spaced to the wickers 18 and slick area 19 on the cylindrical wall of seal pocket 17. The running tool or string (not shown) will then push the energizing ring 41 downward with sufficient force such that the wedge member 61 engages the slot 35 to cause the inner and outer seal legs 27, 29 to move radially apart from each other as shown in FIG. 2. The inner wall 25 of inner seal leg 27 will embed into wickers 18 in sealing engagement while the outer wall 29 of outer seal leg 31 will embed into wickers 12 in sealing engagement. Further, the soft metal inlay 33 on the inner wall 25 will deform against the slick area 19 of the cylindrical wall of seal pocket 17 while the soft metal inlay 33 on the outer wall 29 will deform against the slick area 13 of the wellhead housing bore 11, effect a seal. The soft metal inlays 33 can also embed into wickers 12, 18 depending on the height ratio between the inlays 33 and the slick areas 13, 19.

During the downward movement of the energizing ring 41 relative to the seal assembly 21, the outwardly biased retainer ring 44 rides against recess 53. As shown in FIG. 2, as the wedge member 61 of the energizing ring 41 advances into slot 35, the retainer ring 44 and grooves 55 engage and ratchet by grooves 55 on the inner surface of seal leg 31. As a result, retainer ring 44 locks energizing ring 41 to seal ring 23 as shown in FIG. 2, preventing retainer ring 44 from working its way out of the seal ring 23. Vent passages or penetration holes may be incorporated across wedge member 61 and through upper energizing ring 41 so that a hydraulic lock condition does not prevent axial make-up of the energizer and seal system.

Subsequently, during production, hot well fluids may cause the casing to grow axially due to thermal growth. If so, the casing hanger 15 may move upward relative to the wellhead housing 10. The inner seal leg 27 will move upward with the casing hanger 15 and relative to the outer seal leg 31. The retainer ring 44 will grip the grooves 55 to resist any upward movement of energizing ring 41 relative to outer seal leg 31. The wickers 12, 18 will maintain sealing engagement with the inner wall 25 of inner seal leg 27 and the outer wall 29 of outer seal leg 31.

If the seal formed by the wickers 12, 18 and the inner and outer seal legs 27, 31 is compromised due to excessive thermal growth cycles or higher operating pressures, then some axial movement of the seal ring 23 relative to wellhead housing 10 or the casing hanger 15 may occur. The soft metal inlays 33 deformed against slick area 13 on the wellhead bore 11 and slick area 19 on the cylindrical wall of seal pocket 17 will accommodate this axial movement to maintain sealing engagement during these excessive thermal growth cycles or higher operating pressures by sliding along the slick areas 13, 19.

In the event that seal assembly 21 is to be removed from bore 11, a running tool is connected to threads 43 on upper energizing ring 41. An upward axial force is applied to upper energizing ring 41, causing it to withdraw from slot 35 and retainer ring 44 to disengage grooves 55 on seal leg 31. However, due to retaining shoulders 49, 51, energizing ring 41 will remain engaged with seal ring 23, preventing the two from filly separating (FIG. 1).

In an additional embodiment (not shown), the slick areas 13, 19 are located at the lower ends of the wicker 12, 18 profiles. The soft metal inlays 33 are also located lower on the inner and outer seal legs 27, 31 to correspond with the location of the slick areas.

In an additional embodiment (not shown), the wellhead housing 10 could be a tubing spool or a Christmas tree. Furthermore, the casing hanger 15 could instead be a tubing hanger, plug, safety valve or other device.

While the invention has been shown in only one of its forms, it should be apparent to those skilled in the art that it is not so limited but is susceptible to various changes without departing from the scope of the invention. For example, the seal could be configured for withstanding pressure in two directions, if desired, having two energizing rings. In addition, each energizing ring could be flexible, rather than solid.

What is claimed is:

1. A wellhead assembly with an axis, comprising:

an outer wellhead member having a bore;

an inner wellhead member adapted to be located in the bore;

opposing seal surfaces in the bore and on an exterior portion of the inner wellhead member;

a set of wickers formed in at least one of the seal surfaces and a smooth cylindrical surface adjoining the set of wickers;

a seal ring between the inner and outer wellhead members having inner and outer walls separated by a generally cylindrical slot, an inlay band of a deformable material on one of the walls; and an energizing ring generally cylindrical in shape with surfaces that slidingly engage the inner and outer walls in the slot of the seal ring during installation to push the inner and outer walls into sealing engagement with the inner and outer wellhead members; whereupon one of the walls on the seal ring embeds into the set of wickers and the inlay band deforms against the smooth cylindrical surface adjoining the set of wickers.

2. The assembly according to claim 1, wherein the inlay band has an axial dimension smaller than an axial dimension of the set of wickers.

3. The assembly according to claim 1, wherein the inlay band has V-shaped grooves formed therein prior to deformation.

4. The assembly according to claim 1, wherein the inlay band is made out of a metallic material.

5. The assembly according to claim 1, wherein the inlay is made out of a non-metallic material.

6. The assembly according to claim 5, wherein the non-metallic material is polyphenylene sulfide (PPS).

7. The assembly according to claim 5, wherein the non-metallic material is poly-ether-ether-keytone (PEEK).

8. The assembly according to claim 1, wherein said at least one set of wickers comprises two sets of wickers with the smooth cylindrical surface located there between.

9. The assembly according to claim 8, wherein one of the sets of wickers is formed in each of the seal surfaces;

one of the smooth cylindrical surfaces adjoins each of the sets of wickers; and one of the inlays is located on each of the walls.

10. The seal assembly according to claim 1, wherein an axial dimension of the inlay is greater than an axial dimension of the smooth, cylindrical surface.

11. A wellhead assembly comprising:

an inner wellhead member having a wicker profile and an adjoining slick area on its exterior surface;

an outer wellhead member having a wicker profile and an adjoining slick area on its interior surface; and a metal seal ring having inner and outer walls separated by a slot, comprising:

a soft inlay located on the exterior surfaces of the inner and outer walls; and a metal energizing ring generally cylindrical in shape with surfaces that slidingly engage the inner and outer walls in the slot of the seal ring as the energizing ring moves downward during installation to push the inner and outer walls into sealing engagement between the inner and outer wellhead members; and, while in sealing in sealing engagement, wherein portions or the walls embed into the wicker profiles;

the inlays deform against the slick areas;

and the wicker profiles are located above and below the slick areas on both of the wellhead members.

12. The wellhead assembly of claim 11, wherein an axial length of each inlay is larger than an axial length of the slick area that it engages.

13. The seal assembly according to claim 11, wherein an axial length of each inlay is less than an axial length of either of the wicker profiles.

14. The seal assembly according to claim 11, wherein the soft metal inlay has a V-shaped groove formed therein prior to deformation.

15. The seal assembly according to claim 11, wherein the inlay is made out of a non-metallic material.

16. The seal assembly according to claim 11, wherein the inlay is made out of a metallic material.

17. A method for sealing an inner wellhead member within a bore of an outer wellhead member, comprising:

providing opposing seal surfaces in the bore and on an exterior portion of the inner wellhead member;

providing on at least one of the seal surfaces a set of wickers and a smooth cylindrical surface adjoining the set of wickers;

providing a seal assembly with inner and outer walls separated by a generally cylindrical slot and an inlay band of a deformable material on at least one of the walls;

landing the seal assembly between the inner and outer wellhead members;

driving an energizing ring into the slot in the seal assembly to urge the inner and outer walls of the seal assembly into engagement with the inner and outer wellhead members, wherein:

the inlay band is deformed against the smooth cylindrical surface adjoining the set of wickers, and at least one of the inner and outer walls is embedded against the set of wickers on at least one of the inner and outer wellhead members; and wherein the inner member comprises a casing hanger.

18. The method according to claim 17, wherein the smooth cylindrical surface is placed between upper and lower portions of the set of wickers.

19. The method according to claim 17, wherein the inlay band is placed on each of the walls; and wherein the set of wickers and the smooth cylindrical surface are placed on each of the seal surfaces.

* * * * *